United States Patent [19]

Thorn

[11] Patent Number: 4,858,357

[45] Date of Patent: Aug. 22, 1989

[54] REUSABLE DISPLAY SIGN OR CARD HAVING ALPHANUMERIC INFORMATION

[75] Inventor: George T. Thorn, Etobicoke, Canada

[73] Assignee: Octagon Industries Inc., Mississauga, Canada

[21] Appl. No.: 67,866

[22] Filed: Jun. 30, 1987

Related U.S. Application Data

[63] Continuation of Ser. No. 857,650, Apr. 30, 1986, abandoned.

[51] Int. Cl.[4] ..... G09F 3/04

[52] U.S. Cl. ..... 40/450; 40/584

[58] Field of Search ..... 40/584, 621, 447, 449, 40/450, 600; 434/408, 425; 273/240, 209; 281/31, 30; 106/22; 218/26

[56] References Cited

U.S. PATENT DOCUMENTS

| | | | |
|---|---|---|---|
| 3,692,621 | 9/1972 | Frech | 434/425 |
| 3,834,823 | 9/1974 | Seregely et al. | 106/22 |
| 3,912,520 | 10/1975 | Miyajima et al. | 106/22 |
| 4,248,503 | 2/1981 | Huguenin | 218/26 |
| 4,539,768 | 9/1985 | Halliday | 40/447 |

FOREIGN PATENT DOCUMENTS

| | | | |
|---|---|---|---|
| 3129408 | 3/1983 | Fed. Rep. of Germany | 40/2 R |
| 7600804 | 7/1976 | Netherlands | 434/408 |
| 535133 | 5/1973 | Switzerland | 434/408 |

OTHER PUBLICATIONS

Magne-Signs Inc., Oct. 1984 (Two Pages).

*Primary Examiner*—Gene Mancene
*Assistant Examiner*—J. Hakomaki
*Attorney, Agent, or Firm*—Donald E. Hewson

[57] ABSTRACT

A card for exhibiting and displaying alphanumeric information, such as a pricing sign for retail use, is provided. Generally the card is reusable. At least a portion of the face of the card has a background formed thereon in a dark colour, and a plurality of multi-segmented alphanumeric presentation display digit. Each of the display digits has at least seven bar segments so arranged as to form the digit "8". Various alphanumeric digits or letters can be formed by changing the colour of none or some of the bar segments of each display digit, so as to change its value, using a marker having an ink which is substantially the same colour as the colour of the background. The changed displays thereby present alphanumeric data, most usually pricing data, as desired. The card may be reused by wiping the changed display digits with a dampened wiping means which may carry water or a specific solvent, depending on the nature of the ink that has been used in the marker when the display digit was first changed. The display cards may be very economically produced and provided in large quantities to major retailers as well as to small independent retailers. The cards may also be used such as for inventory and stock control, and the like.

9 Claims, 1 Drawing Sheet

REUSABLE DISPLAY SIGN OR CARD HAVING ALPHANUMERIC INFORMATION

A continuation of 857,650, Apr. 30, 1986, now abandoned.

FIELD OF THE INVENTION

This invention relates to apparatus for displaying alphanumeric information, and a method of displaying and changing alphanumeric information. More particularly, the invention relates to cards for displaying alphanumeric information such as pricing and the like, or for such purposes as inventory control; and it is a feature of the present invention that the cards may be re-used. By being re-used, what is meant is that the alphanumeric information which may be placed on the card in one instance can be changed for re-use of the card in another instance.

The cards of the present invention are presented having a plurality of display digits, each taking the form of a seven bar digit "8". The value of any display digit can be changed by blanking or obscuring some or none of the bar segments. In general, each card has a background of a first, dark color, and the bar segments of each display digit against the background are of a second contrasting and lighter color. The bar segments may be altered by colouring each bar segment with an ink of substantially the same color as the background using a marker which may also be provided by this invention, thereby substantially visually obscuring the marked bar segments.

BACKGROUND OF THE INVENTION

In many circumstances, such as retail sales, it is often desirable to present or display information such as pricing, or even stock or code numbers, relevant to any given item. Thus, for example, in a supermarket or other retailer having high inventory turnover, prices may change from week to week, or possibly even daily On the other hand, certain other kinds of retailers may have fixed or constant prices that may last for weeks or months at a time. Similarly, inventory control may require that the identifying information as to any bin of parts, for example, may require only relatively seldom changes—perhaps only once or twice in a year.

All of those circumstances, and of course many others, lend the themselves to utilization of the apparatus and method of the Present invention. In all events, the card presents and displays alphanumeric information—which may be alphabetic or numeric, usually numeric—by presenting what is essentially a universal digit "8" having much the same appearance as that which is shown on an ordinary LCD (liquid crystal display) watch, where none or some of the bar segments may be altered so as to change the value of the display digit that is shown.

In the usual circumstance, and for the best visual display, the multi-segmented alphanumeric presentation display digits are preferably formed in a contrasting light colour to the dark colour of the background on which they are presented.

Therefore, the present invention provides not only a card for exhibiting and displaying alphanumeric information, it provides also the means by which the alphanumeric information may be altered or amended. The overall apparatus thus includes the card and a marker. At the same time, recognition is made of the fact that, on occasion, it may be that once a card has been marked it will not be marked again. This, however, remains in keeping with the present invention, in that a number of standard cards may be obtained, and in any event each card may be marked differently than any other card by obscuring various ones of the bar segments of each of the multi-segmented alphanumeric presentation display digits, so as to present specific alphanumeric information.

It also follows, therefore, that a method of exhibiting, displaying, and changing alphanumeric information is provided by the present invention, by not only providing the card but a marker, and by providing a means whereby the specific alphanumeric data which may be displayed in a readable manner may be changed by changing the colour of none or some of the bar segments of each multi-segmented digital display. Once again, as noted above, once any bar segment has been changed, only the unchanged bar segments are thereafter readily visible and distinguished from the background field, because of the equivalence of the color of the marker ink and the color of the background field, and because of the contrast of the color of the unmarked bar segments to that of the background field.

Obviously, similar presentations can be made electronically, using either LED's (light emitting diodes), LCD's (liquid crystal displays), and so on. However, it is very obvious that the installed capital cost of any electronically operated alphanumeric display, on which the display may be varied from time to time is very high. However, for such static purposes as Pricing or other information display, it is often not necessary to undertake the capital costs of electronic devices.

There are several other mechanical devices known in the prior art, but they also represent very high and significant capital costs. For example, NIDELKOFF in U.S. Pat. No. 4,115,936 dated Sept. 26, 1978, teaches to a sign which has self-storing characters that are quickly changeable. However, although the background and the characters may have color contrast and/or illumination, the change is made by moveable shutters—in other words, using moveable and specific mechanical pieces. Obviously, the capital costs of such a device are quite high.

A similar device, having bar segments which may be altered using magnetic material, is shown in ROBINSON et al, U.S. Pat. 4,507,888 issued Apr. 2, 1985. Yet another device is shown in HALLIDAY, U.S. Pat. No. 4,539,768 issued Sept. 10, 1985. Here again, specific flaps or mechanical means are required to change each segment so as to alter its value.

It will be noted that when a universal, seven-segment, standard digit "8" is used, with the exception of changing two bar segments which increases the value of the "8" to "9", that otherwise changing bar segments results either in a lower value or a substantially meaningless symbol. This is not often of concern, but when it is of any concern several security measures can be taken which preclude inadvertent or malicious changes to cards according to the present invention. For example, a simple expedient may simply be to place cards behind a clear cover plate, in much the safe manner as price cards are often placed between clear sheets of plastic in stands or holders. Another step that may be taken in order to secure the integrity of the digital or alphanumeric information being displayed, as discussed in greater detail hereafter, is to use special inks and/or special surfaces on the cards. Thus, it may be possible that the cards—that is, the bar segments on the cards—may not be altered except using inks that will somehow favourably react with or cover the material of the surface of the card; or, it may be that inks will be used that may not be removed from bar segments except using special solvents.

In some instances, for visual purposes and perhaps for alphanumeric display purposes, it may be convenient to display the universal "8" having twinned pairs of bar segments. The appearance of such displays is discussed in greater detail hereafter.

STATEMENT OF INVENTION:

It follows, from the above, that the present invention in its broadest sense provides a card for exhibiting and displaying alphanumeric information. No matter whether the information is to be changed from time to time, or once specific alphanumeric information has been placed on the card and will thereafter remain intact, it is fundamental to the present invention that the card has a face which for the most part is substantially planar or smooth. It may be, and generally is, a flat card, but it may be formed in a circular manner—such as might be used on rotating displays on the retail floors of supermarkets or department stores, for example, or to advertise the current price for the sale of gasoline.

In any event, at least a portion of the face has permanently placed thereon a background field which is of a first, dark colour. A plurality of multi-segmented alphanumeric presentation display digits are provided, where each display digit comprises at least seven bar segments which are so arranged as to form the digit "8". In each case, therefore, there is at least a top, a middle, and a bottom bar segment, each of which is usually substantially horizontally directed. There are two further pairs of side bar segments, one pair extending from near each end of the top bar segment to near each end of the middle bar segment, and the other pair extending from year each end of the middle bar segment to near each end of the bottom bar segment. It is, again, a feature of the present invention that each bar segment of each display digit is of a second and contrasting, usually much lighter, color than the first, darker, colour of the background field. As noted hereafter, the background field is usually black, but it may be dark blue, dark red, dark green, etc.; and the bar segments are usually white but may be light or pastel shades.

Thus, specific alphanumeric data may be displayed in readable manner by changing the color of none or some of the bar segments of each display digit from the second colour to the first colour, so that only the unchanged bar segments are readily visible and distinguished from the background field.

From the above, it follows that the present invention provides an apparatus including a marker for marking the bar segments, where the marker has an ink therein which is substantially of the same colour as the colour of the background field.

Again, since it is the usual purpose—although not necessarily or absolutely required—that the present invention provides means not only for exhibiting and displaying alphanumeric information, but also for changing it, it follows that the ink in the marker is erasable—at least using suitable or appropriate solvents.

In its broadest sense, the ink in the marker may be water soluble, so that it may be removed from any changed bar segments on any card according to the present invention, simply by wiping that changed bar segment with a water-dampened wiping means. It has also been noted that, for security purposes, it may be desirable in certain circumstances that the ink in the marker is soluble only in a specific solvent, so that it may be removed from any changed bar element only by wiping that changed bar element with wiping means which carries the specific solvent in releasable form.

Thus, not only does the present invention provide cards for exhibiting alphanumeric information, it provides apparatus or systems for exhibiting, displaying and changing alphanumeric information, and it also provides a method for exhibiting, displaying, and changing alphanumeric information.

BRIEF DESCRIPTION OF THE DRAWINGS

Specific features of the present invention will now be discussed, in association with the accompanying drawings, in which.

Figure 1:
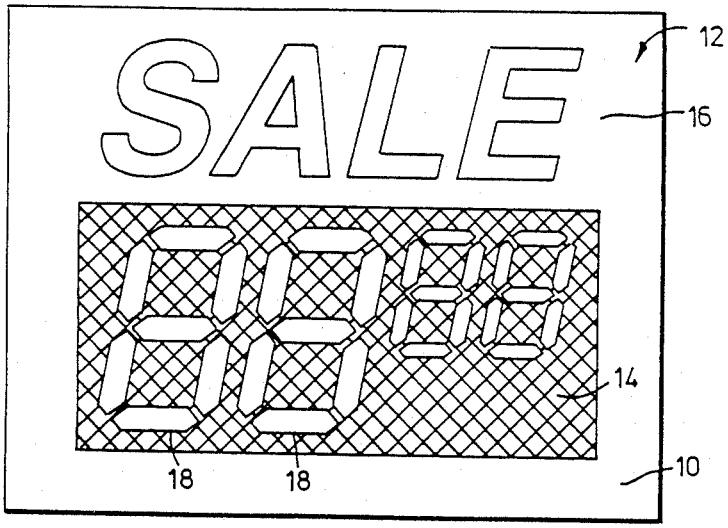
FIG. 1 is a representation of a typical card according to the present invention, having multi-segmented alphanumeric display digits against a background field.

DESCRIPTION OF THE PREFERRED EMBODIMENTS:

FIG. 1 shows a card 10, for exhibiting and displaying alphanumeric information. On at least a portion of the face 12 of the card 10, there is a field or background field 14. That background field 14 is permanently placed on the face 12 of the card 10, and is usually a solid colour which is a dark colour. As noted above, the colour of the background field 14 is usually black, but it may be such other colours as dark green, dark red, dark blue, etc.

A typical card may have a message imprinted thereon, such as the word "SALE" indicated at 16; of course, it may have other words or lengthy messages, or there may be no additional specific permanent information on the card 10.

On the background field 14, there are a plurality of multi-segmented alphanumeric presentation display digits 18. The number of presentation display digits 18 will vary from card to card, depending on the general purpose to which it will be put. For example, the card which is shown in FIG. 1 will display prices up to $99.99; in other instances it may be necessary—such as on the floor of a retail automobile dealer—to display prices up to $99,999.99—that is to say, at least above $10,000.00.

Figure 2:
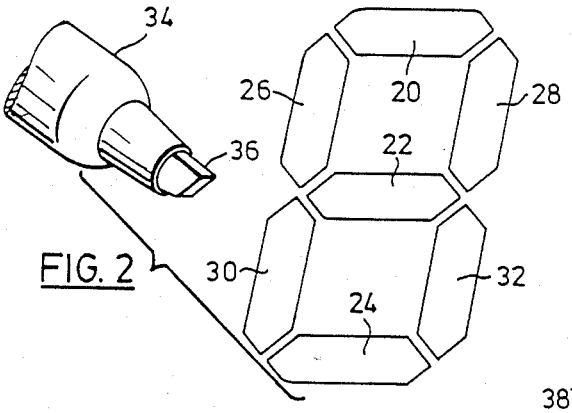
FIG. 2 is representative of the manner in which an alphanumeric display digit according to the present invention may be altered.

Referring specifically to FIG. 2, it will be noted that each of the seven segment universal "8" digits comprises at least seven bar segments. They include the top bar segment 20, the middle bar segment 22, and the lower bar segment 24. There are two pairs of side bar segments, the pair 26 and 28 extending at either side from near the ends of the upper bar segment 20 to near the ends of the middle bar segment 22; and the pair 30 and 32 extending from near the ends of the middle bar segment 22 to near the ends of the bottom bar segment 24.

As shown in FIG. 1, the colour of each of the alphanumeric presentation display digits 18 is of a second contrasting, lighter colour than the color of the background field 14. As mentioned, that colour is usually white; but may be pastel shades, for example.

To alter the value of any alphanumeric display digit 18, means such as the marker 34 having a marker tip 36 may be used. The ink in the marker 34 transfers from the marker to the card 10 at the marker tip 36, and in order to provide a meaningful presentation the color of the ink in the marker 34 should be substantially the same as that of the background field 14. Thus, if for example bar segments 24 and 30 are marked out so as to be indistinguishable from the background field 14, leaving the other five bar segments distinguished from the background field 14, the digit "9" is presented.

Figure 4:
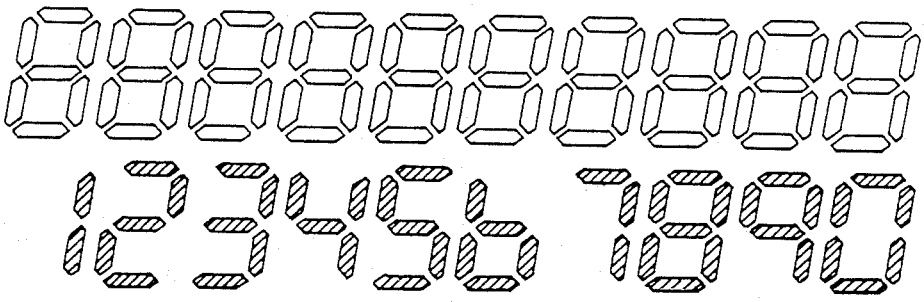
FIG. 4 is a representation showing each of the digits 1 through 0 and the manner in which each digit may be derived from a seven segment universal "8".

All of the digits 1 through 0 are shown, and the manner of their presentation, in FIG. 4. Alphabetic information is also possible, although it usually comprises a mix of upper case and lower case letters. For example, obscuring the bottom bar segment 24 results in an upper case "A", while obscuring bar segments 20 and 28 may result either in a "6" or a lower case "b"; to be determined from the context of surrounding and/or adjacent display digits 18. Nonetheless, a full alphanumeric display having all twenty-six letters of the English alphabet and all ten digits, is possible using a universal, seven segment "8".

Figure 3:
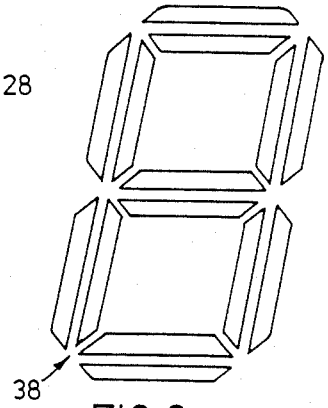
FIG. 3 shows an alternative style of a display digit using twinned bar segments.

An alternative display digit 38, using twinned bar segments, is shown in FIG. 3. It may be used in some instances so as to more particularly distinguish the presentation of a digit "6" from a lower case "b"; or it may be used strictly for stylistic purposes—such as when the prices being displayed are relatively high.

Once any of the bar segments have been marked, it is simply a matter of wiping the marked bar segments with water or a suitable solvent, as discussed above, to change the digit being displayed, or to return it to the "8" condition. In any event, it is clear that the display will remain with the altered information unless and until it is changed using a suitable wiper—and a specific solvent, if necessary.

If the surface material of the card, the permanent marking paint or ink which is used to mark the background field 14, and the type and colour of the ink in the marker 34, are all carefully chosen, a changed card according to the present invention may be such that only the unchanged bar segments are readily visible and distinguished from the background field, even from a relatively close inspection. This gives the retailer, or other user, the opportunity to purchase and use substantially standard (or standardized) cards and markers. Of course, some cards may carry different fixed messages from others, and may carry different numbers of digits, but still the number of different cards may be substantially reduced. This is enhanced by the fact that the cards are re-usable, so that the capital cost of acquiring the cards and the markers for changing them, is relatively insignificant.

It has been noted that there are a variety of potential users of the apparatus and method taught by the present invention. The first and most obvious user is, of course, a retail merchant; other potential users include factories and/or distributors requiring inventory control of such items as bulk inventory. Still other potential users may include commercial and financial institutions where the alphanumeric information to be displayed and/or changed may include days and hours of business. Also, many commercial and/or financial institutions may, in their retail or public operations, wish to have displays which are constantly changing as to such items as interest rates being paid or charged for various services, currency exchange rates, and the like.

Yet another potential use of the present invention is in an educational sense, where the users may be children who can apply learning skills while at the same time having enjoyment of such tasks as learning arithmetic. Specifically, a card may be designed having two or more columns of display digits beside the bottom most of which there may be a further symbol which essentially comprises the super imposition of a plus sign (+) and the letter "x" in eight or ten distinct segments (if ten, the vertical stroke comprises four segments) from which can be derived all four arithmetic function symbols of addition, subtraction, multiplication, and division. Below the lower most row, a permanently marked line may be placed, below which a further row of display digits would be produced, having more display digits than any of the rows above the line. Such a card and the requisite marker may be offered, for example, as a premium or "gift" in a marketing campaign by manufacturers such as cereal manufacturers, publishers of books and magazines for young children, and the like.

There has been described a card for exhibiting and displaying alphanumeric information, which card may be changed by marking none or some of the bar segments on it, a system or apparatus including the card and a marker; (or wiping previously marked bar segments); and a method of exhibiting, displaying and changing alphanumeric information. The appended claims define the ambit of the present invention.

I claim:

1. In a card for exhibiting and displaying alphanumeric information, which information may be changed form time to time, where the card has a face of which at least a portion thereof has permanently placed thereon a background field of a first, dark colour; where there are a plurality of multi-segmented alphanumeric presentation display digits on said background filed; where each display digit comprises at least seven bar segments which are so arranged as to form the digit "8", having at least a top, a middle and bottom bar segment each of which is substantially horizontally directed; and further having two pairs of side bar segments, one pair extending form near each end of the top bar segment to near each end of the middle bar segment, and the other pair extending from near each end of the middle bar segment to near each end of the bottom bar segment; and where each bar segment of each display digit is of a second contrasting, lighter colour than said first colour;

the improvement wherein said face is substantially planar and smooth, and is adapted for receiving removable pigmentation applied thereto substantially on the plane of the face and in an evaporable liquid base, to effectively obscure selected bar segment portions of selected ones of said digits, said pigmentation being selectively removable therefrom by wiping with a suitable solvent to restore said digits;

whereby specific alphanumeric data may be displayed in readable manner by changing the colour of none or some of the bar segments of each display digit form said second colour to said first colour, in order that only the unchanged bar segments are readily visible and distinguished from the background field.

2. The card of claim 1 together with a marker, the combination thereof presenting an apparatus for exhibiting, displaying and changing alphanumeric information;

wherein said marker has an erasable ink therein which is substantially of the same colour as said first colour of said background field, said ink being erasable with the said of a solvent therefor;

whereby specific alphanumeric data may be electively displayed in readable manner by changing and recharging the colour of none or some of the bar segments of each display digit from said second color to said first colour, by marking each segment to be changed using said marker, and from said first colour to said second colour by erasing said erasable ink so that only the unchanged bar segments in said second colour are thereafter readily visible and distinguished from said background field.

3. The apparatus of claim 2, where the ink of said marker is water soluble, and may be removed from any of said changed bar segments by wiping said changed bar segment with a water-dampened wiping means.

4. The apparatus of claim 2, where the ink of said marker is soluble only in a specific solvent, and may be removed from any of said changed bar segments only by wiping said changed bar segment with a wiping means which carries said specific solvent in releasable form.

5. The card of claim 1, where at least one of said display digits comprises at least seven twinned pairs of bar segments arranged in same manner so as to form a digit "8" where each arm thereof is one of said twinned pairs of bar segments.

6. The apparatus of claim 2, where at least one of said display digits comprises at least seven twinned pairs of bar segments arranged in same manner so as to form a digit "8" where each arm thereof is one of said twinned pairs of bar segments.

7. A method of exhibiting, displaying, and changing alphanumeric information which comprises the steps of: providing a card and marker;

where said card has a visually unobstructed face which is substantially planar or smooth;

at least a portion of said face having permanently placed thereon a background filed of a first, dark colour;

there being a plurality of multi-segmented alphanumeric presentation display digits on said background field;

where each display digit comprises at least seven bar segments which are so arranged as to form the digit "8", having at least a top, a middle and a bottom bar segment each of which is substantially horizontally directed; and further having two pairs of side bar segments, one pair extending from near each end of the top bar segment to near each end of the middle bar segment, and the other pair extending from near each end of the middle bar segment to near each end of the bottom bar segment;

each bar segment of each display digit being of a second contrasting, lighter colour than said first color;

said marker having an erasable ink therein which is substantially of the same colour as said first colour of said background field, said ink being erasable with the said of a solvent therefor to reinstate a previously obscured digit;

whereby specific alphanumeric data may be display in readable manner by reinstating, where necessary said obscured digit, and by changing the colour of none or some of the bar segments of each display digit from said second colour to said first colour, by marking each segment to be changed using said marker, so that only the unchanged bar segments are thereafter readily visible and distinguished from said background field;

and using said marker to change said bar segments as required.

8. The method of claim 7, where the ink of said marker is water soluble, and may be removed from any of said changed bar segments by wiping said changed bar segment with a water-dampened wiping means.

9. The method of claim 7, where the ink of said marker is soluble only in a specific solvent, and may be removed from any of said changed bar segments only by wiping said changed bar segment with a wiping means which carries said specific solvent in releasable form.

* * * * *